US008985071B2

(12) United States Patent
Newman

(10) Patent No.: US 8,985,071 B2
(45) Date of Patent: Mar. 24, 2015

(54) INTERNAL COMBUSTION ENGINE , IMPROVEMENTS IN DESIGN AND EFFICIENCY

(75) Inventor: Graeme Harold Newman, Auckland (NZ)

(73) Assignee: Graeme Harold Newman, Papatoetoe, Auckland (NZ)

( * ) Notice: Subject to any disclaimer, the term of this patent is extended or adjusted under 35 U.S.C. 154(b) by 0 days.

(21) Appl. No.: 13/068,879

(22) Filed: May 24, 2011

(65) Prior Publication Data

US 2012/0067308 A1 Mar. 22, 2012

(51) Int. Cl.

| | |
|---|---|
| ***F02B 25/00*** | (2006.01) |
| ***F02B 75/20*** | (2006.01) |
| ***F02B 33/04*** | (2006.01) |
| ***F02B 75/22*** | (2006.01) |
| ***F02B 71/00*** | (2006.01) |
| ***F02B 75/28*** | (2006.01) |
| *F01B 3/08* | (2006.01) |

(52) U.S. Cl.

CPC *F02B 75/282* (2013.01); *F01B 3/08* (2013.01)

USPC ..... 123/65 S; 123/58.5; 123/58.6; 123/73 F; 123/55.2; 123/46 A

(58) Field of Classification Search

USPC ..... 123/55.2, 65 S, 46 A, 58.5, 58.6, 73 F

See application file for complete search history.

(56) References Cited

U.S. PATENT DOCUMENTS

| | | | | |
|---|---|---|---|---|
| 5,955,151 | A * | 9/1999 | Hajmrle et al. | 427/456 |
| 7,779,627 | B1 * | 8/2010 | Ries | 60/325 |

* cited by examiner

*Primary Examiner* — Lindsay Low
*Assistant Examiner* — Syed O Hasan

(57) ABSTRACT

The converting of linear motion into rotational energy when using the cylinders and pistons of an internal combustion engine without the use of a crankshaft.

The replacement with dual high lead cam-screws and dual cam-followers allows for the efficient use of a complete combustion stroke without the resistance from the crankshaft at top dead center, and a greatly reduced resistance for the return stroke as there is no crankshaft turning resistance at the outer limit of the piston stroke.

4 Claims, 2 Drawing Sheets

INTERNAL COMBUSTION ENGINE , IMPROVEMENTS IN DESIGN AND EFFICIENCY

FIELD OF THE INVENTION

The present invention relates to internal combustion engines.

More specifically, it relates to the replacement of the crankshaft with an alternative energy receptive device.

SUMMARY OF THE INVENTION

It is the objective of the present invention to replace the crankshaft in the internal combustion engine with a new device that converts linear energy into rotational energy with greater mechanical efficiency.

One form of the present invention is a horizontally opposed engine that uses a stepped or standard piston assembly in which two stepped or standard pistons are connected by a central shaft and converts linear motion into rotational energy by the use of an overrunning clutch transitorily fastening onto this shaft on combustion stroke.

The central shaft is free to rotate at its central axis but it is held captive linearly which then transfers this energy onto dual cam-followers that are held captive by the central shaft but at 90° to same, which in turn transfers this energy by dual spiral high lead slotted cam-screws that energize a thick-wall tube to rotate and maintain kinetic momentum, which in turn creates a toothed gearwheel on its axis, fastened to the thick-walled tube, to transmit its rotation to a transmission.

DESCRIPTION OF PREFERRED EMBODIMENTS

Figures 1, 1A, 1B, 1C:
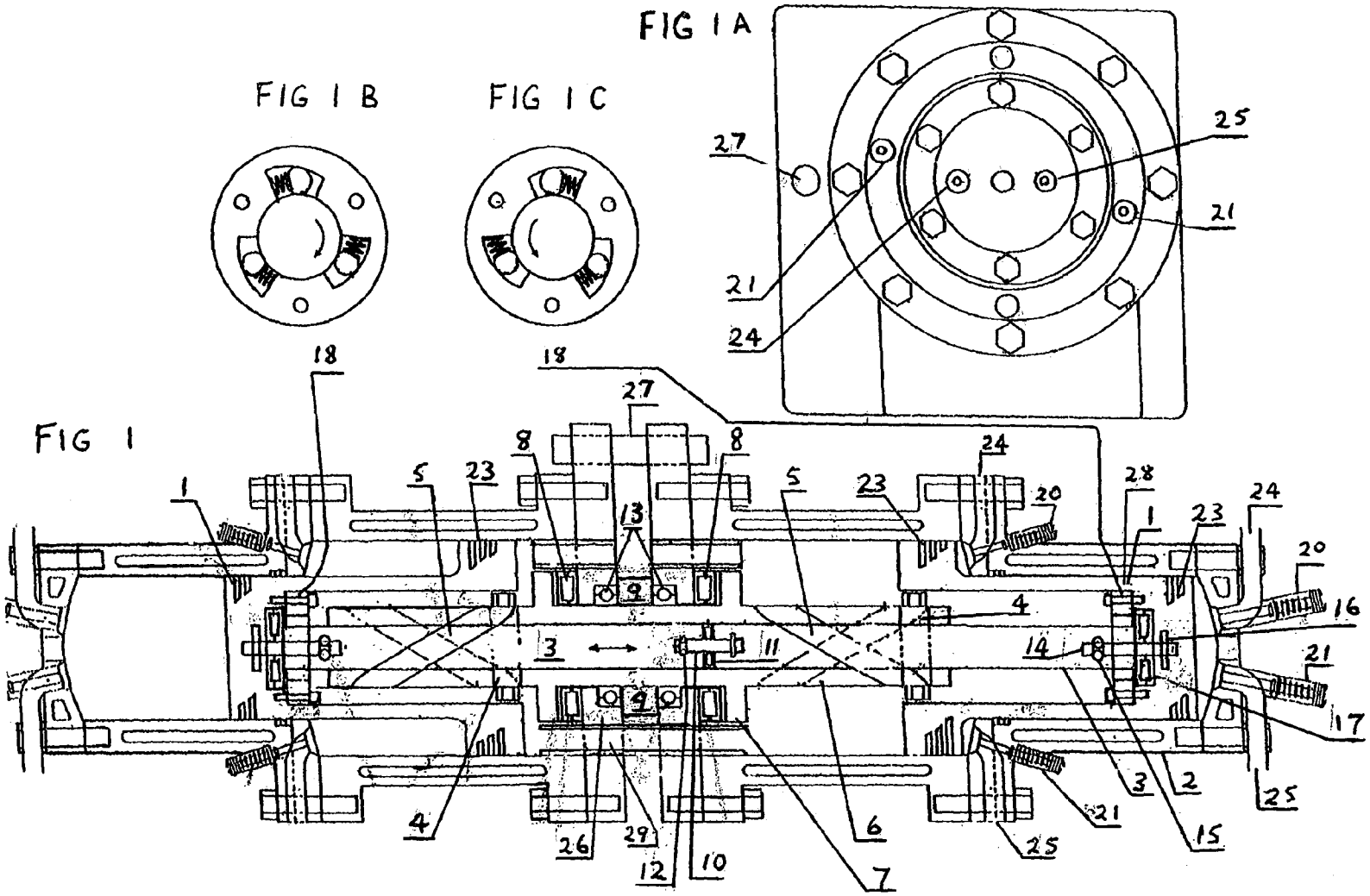
FIG. 1 is a cross-section of an internal combustion engine in accordance with the present invention.
FIG. 1A is an end elevation of the internal combustion engine shown in FIG. 1.
FIG. 1B and FIG. 1C are cross-section views of one type of overrunning clutch to maintain shaft rotation in one direction.
Figure 2B:
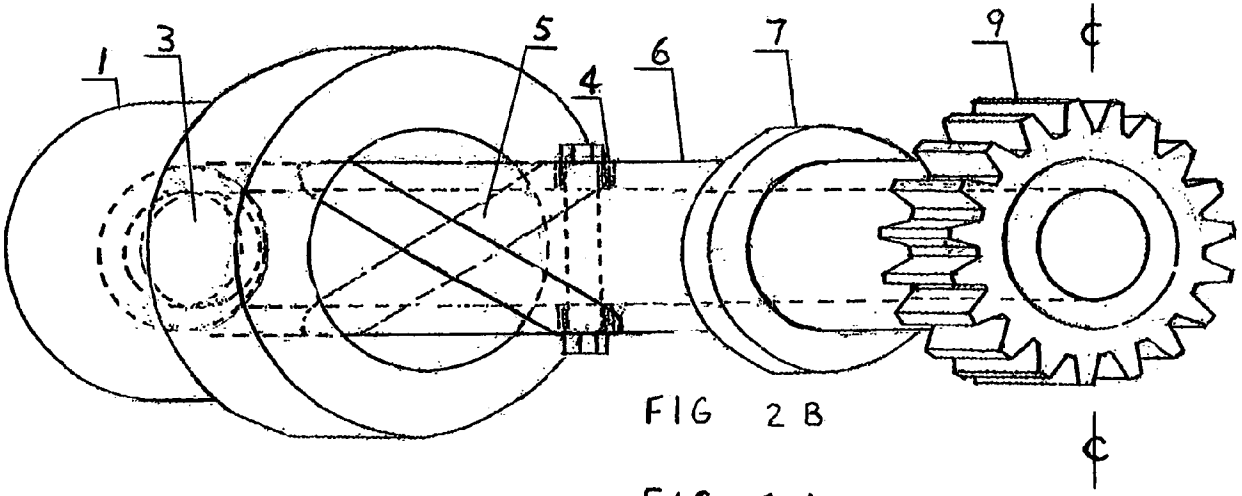
FIG. 2A and FIG. 2B are complete cutaway perspective views of the central shaft as removed from the engine housing, that is joined at C-C, including the thick-wall tube, viewed from the piston positioned at top dead centre FIG. 2A, 28 with numbers collated to FIG. 1.
Figure 2A:
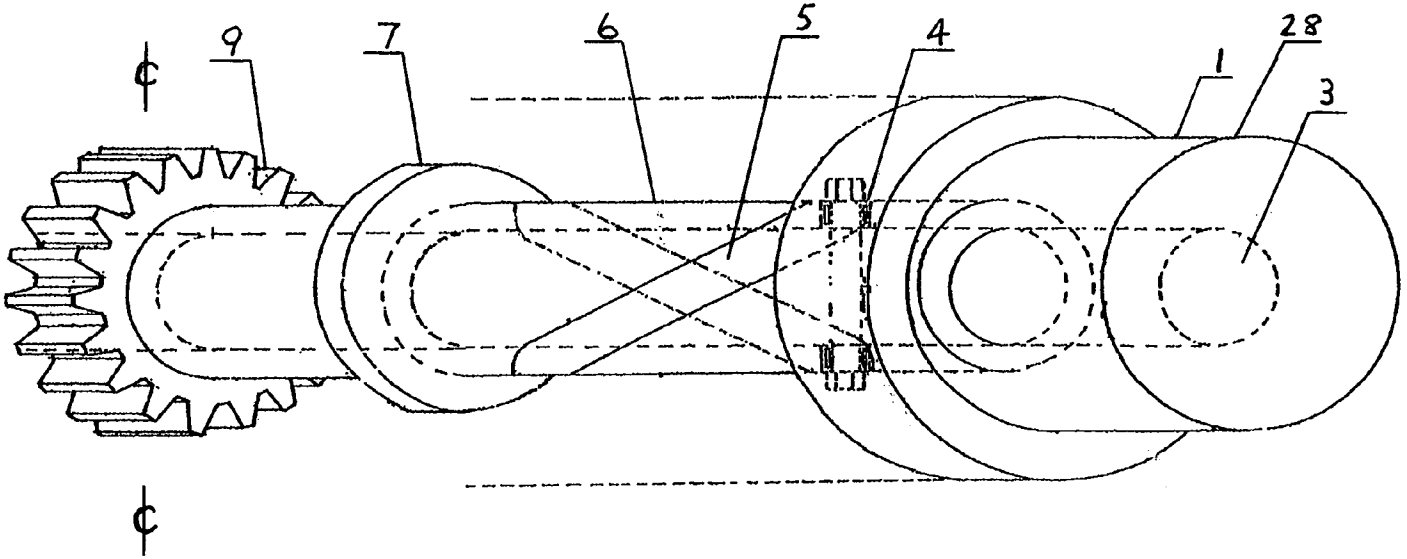

An internal combustion engine with opposing stepped 2 or standard cylinders (not shown) are connected by the engine body that surrounds an energy-receiving device.

Two pistons either stepped 1 or standard (not shown) positioned so as to move jointly in their respective cylinders 2 in two opposing directions when held axially by a central shaft 3 with this same central shaft free to rotate at its axis but held captive linearly by a pin-rod 10 with a rotating locator bearing 12 at one end and axial thrust bearing 11 to sustain and contain axial movement when the central shaft is loaded or unloaded, at the other end.

The pistons are positioned at the ends of the central shaft with a locating axial pin 14 that also allows the central shaft to rotate by means of a bearing 15 and is fixed beneath the piston head at 16 to hold captive the piston and rod assembly linearly with a thrust bearing at 17 to support combustive force.

Attached to the piston head base are cylindrical roller, right and left-handed overrunning clutches 18 that fasten onto the central shaft to transfer linear energy from the piston under combustion 28, through the activation of the overrunning clutch transitorily fixing the position of the central shaft; this energizes the cam-followers 4 that are fixed through the central shaft at right-angles to the central shaft and at maximum stroke from the piston head, which in turn acts on the dual spiral high lead slotted cam-screws 5 machined within a thick-walled tube 6, from the top of the stroke of the piston acting on the thick-wall tube through 180° plus or minus, to the bottom of the stroke to create rotatory motion, whereby this rotatory motion is transferred by a toothed gear wheel 9, fastened at the axis of the thick-walled tube, whereupon the overrunning clutch will release its fixation and return by the opposing combustion cycle to its departure position.

The thick-walled tube is retained by its flange 7 thrusting against the engine body 26 and rotates on the thrust bearing 8 and peripheral bearing 13, which in turn rotates the toothed gear wheel 9 fastened at the axis of the thick-wall tube which would in turn energize a toothed gear wheel (not shown) if placed on the axle at 27 to transfer energy to a transmission. The thick-walled tube operates as a flywheel to maintain kinetic momentum.

The alternative piston assemblies with piston rings 23 would use inlet and exhaust valves 20, 21 with ports 24, 25 with air-fuel mixture and ignition plugs (not shown) or their alternative with injectors (not shown).

There is one only bypass passage 29 to allow airflow from one compressive cylinder to another with an air pressure sensitive switch (not shown) or some other to forward a timing signal to an engine management system (not shown) for ignition and valve timing for inlet and exhaust, or some other device for this purpose.

What I claim is:

1. A horizontally opposed engine that uses a stepped piston assembly in which two stepped pistons are connected via a central shaft device comprising: a central shaft that is free to rotate at its central axis at all times, and translates linear motion into rotational energy by an overrunning clutch transitorily fixing a position of one half of the central shaft followed by the transfer of energy to dual cam-followers acting on dual spiral high lead slotted cam screws that permit a thick-wall tube to rotate; which then creates a toothed gear wheel on its axis to transmit its rotation to a transmission; whereupon the overrunning clutch releases its fixation; wherein the stepped piston is two pistons in one disposed in different sized cylinders having their own intake and exhaust valves and spark plugs.

2. A central thick-wall tube as in claim 1 that has triple spiral high lead slotted cam-screws and triple cam-followers (not shown).

3. A central thick-wall tube as in claim 1 that has quadruple spiral high lead slotted cam-screws and quadruple cam-followers (not shown).

4. A central thick-wall tube with said dual spiral high lead slotted cam-screws as in claim 1, when energized by said dual cam-followers, which in turn are energized by said piston under combustion when fixed in position by said overrunning clutch that maintains kinetic momentum attained until the next combustive cycle.

* * * * *